United States Patent [19]

Lovas et al.

[11] Patent Number: 4,638,625

[45] Date of Patent: Jan. 27, 1987

[54] PROCESS AND APPARATUS FOR STOPPING AND RESTARTING AN OPEN-END SPINNING MACHINE WITH A PLURALITY OF SPINNING DEVICES

[75] Inventors: Kurt Lovas, Böhmfeld; Franz Deisinger, Ingolstadt, both of Fed. Rep. of Germany

[73] Assignee: Schubert & Salzer Maschinenfabrik, Ingolstadt, Fed. Rep. of Germany

[21] Appl. No.: 462,023

[22] Filed: Jan. 28, 1983

[30] Foreign Application Priority Data

Feb. 17, 1982 [DE] Fed. Rep. of Germany ..... 3205535

[51] Int. Cl.[4] ..... D01H 15/02

[52] U.S. Cl. ..... 57/263

[58] Field of Search ..... 57/261, 262, 263

[56] References Cited

U.S. PATENT DOCUMENTS

| | | | |
|---|---|---|---|
| 3,680,300 | 8/1972 | Landwehrkamp | 57/263 |
| 4,083,171 | 4/1978 | Konig et al. | 57/263 |
| 4,089,155 | 5/1978 | Stahlecker | 57/263 |
| 4,223,517 | 9/1980 | Husges et al. | 57/261 |

FOREIGN PATENT DOCUMENTS 116998 12/1965 Czechoslovakia .

OTHER PUBLICATIONS

Suessen Brochure, "Suessen WST-Technische Mitteilung", pp. 1-8, Jul., 1979.

*Primary Examiner*—John Petrakes

*Attorney, Agent, or Firm*—Julian W. Dority

[57] ABSTRACT

To stop and restart and open-end spinning machine with a plurality of spinning devices, all the spinning devices are stopped together, while the vacuum is maintained. The thread end resulting from this interruption in the spinning process is then prepared successively at each spinning unit for joining and is fed to the spinning device in a thread-joining position, whereupon the vacuum is then cut off. When the open-end spinning machine is started, after the vacuum has first been applied, the threads are fed together, on all the spinning devices to the fiber-collecting surfaces of the spinning devices. The open-end spinning machine has a service device movable along the machine for preparing the threads to be joined and for feeding them to the individual spinning cells, as well as a central control device which has a stoppig device and a starting device for the open-end spinning machine. The stopping device is connected in control terms to a switch-on device and to a switch-off device for the service device. By these means it is possible, when stopping the machine, to let it run by itself to prepare and feed the thread ends and to switch itself off.

12 Claims, 3 Drawing Figures

PROCESS AND APPARATUS FOR STOPPING AND RESTARTING AN OPEN-END SPINNING MACHINE WITH A PLURALITY OF SPINNING DEVICES

FIELD OF THE INVENTION

The present invention relates to a process for stopping and restarting a previously shutdown open-end spinning machine with a plurality of spinning devices, each of which contains a spinning cell working under a vacuum and having a fiber-collecting surface, and a spooling device, as well as to an open-end spinning machine for carrying out this process.

BACKGROUND OF THE INVENTION

In thread-joining, great emphasis is laid, nowadays, on good piecers, so that these do not subsequently have to be cleaned out, in an additional operation, by separating out and knotting the thread ends obtained. For this purpose, the otherwise conventional mass threadjoining has often been abandoned (see "Suessen WST Technical Report - SUESSEN - WST CleanCat - SUESSEN - WST SpinCat for the automation of rotor spinning machines", 5.1-03 OOO D 7.79, page 4, paragraph 9, no more "mass thread-joining", or the piecers are replaced by knots immediately following the mass thread-joining (German Offenlegungsschrift No. 2,758,064), this being carried out, in turn, by means of a service device movable along the open-end spinning machine. However, since this service device requires a relatively long time for its work, obtaining high-grade piecers or eliminating poorer piecers has hitherto meant a production loss.

The object of the present invention is to provide a process and a open-end spinning machine which allow uniform thread-joining conditions at the individual spinning units without a production loss.

SUMMARY OF THE INVENTION

This object is achieved, according to the invention, due to the fact that all the spinning devices are stopped together, although the vacuum is further maintained, the thread end resulting from the interruption of the spinning process is prepared successively at each spinning unit for thread-joining and is fed to the spinning device in a thread-joining position, whereupon the vacuum is also cut off, and when the open-end spinning machine is started after the vacuum has been applied, the threads located in the thread-joining position are fed to the fiber-collecting surfaces in a known way. This makes it possible, after production has ended, for the service device, as a result of switching-on of the stopping program of the open-end spinning machine to move along the spinning units assigned to this service device, and at the same time for the thread end to be brought in a conventional way, at one spinning unit after the other, into the best possible state for being joined, whereupon the thread end prepared in this way is fed to the spinning cell which has meanwhile been stationary but is still under a vacuum. Since the spinning cell has been stopped, the thread end does not undergo any twisting here, even when it extends up to the fiber-collecting surface of the spinning cell. When the vacuum is now cut-off, the thread end remains in the spinning cell because of its length. When the spinning machine is started, as a result of the vacuum being applied, the thread ends are held tensioned at all the spinning units and, at least during the starting of the spinning cells, are held at a distance from the fiber-collecting surfaces of the latter, so that when they are started up the thread ends cannot be twisted off or impaired in any other way. Finally, when, after the vacuum has been applied and the spinning cells switched on, the latter have reached their operating state, at all the spinning units the threads are simultaneously fed to the fiber-collecting surfaces of the spinning cells for joining, the fiber feed as well as the the thread draw-off and the winding-on being switched on again in a known way. It is thereby possible to carry out preparation of the thread ends for joining, after the production time has ended, so that the outlay in terms of time required for this entails no production losses whatsoever. When the open-end spinning machine is to be started up again, this takes place as a result of the simultaneous joining of the threads at all the spinning units, although because of this individual preparation of the thread ends after production has ended constant and reproducible thread-joining conditions and consequently high-grade piecers are obtained.

In order, it is true, on the one hand to feed the threads reliably to the spinning cells, but, on the other hand, to prevent a harmful influence on the threads during the starting of the spinning cells, the threads are delivered, advantageously before the vacuum is cut off, up to the fiber-collecting surfaces of the already stopped spinning cells, but then, before the spinning cells are put into operation, are brought into the thread-joining position by being drawn simultaneously and partially out of the spinning cells, with threadjoining reserves being formed at the same time, and these thread-joining reserves are released simultaneously, after the spinning cells have been put into operation, for thread-joining. Appropriately, the thread-joining reserves are formed, during the starting of the open-end spinning machine, after the vacuum has been applied, since, during the shutdown of the machine, because of their length located in the spinning device, the threads are secured in this.

Depending on the geometrical conditions and the process for stopping and starting the open-end spinning machine, it may also be advantageous, however, if the ends of the threads partially drawn out of the spinning cells to form thread reserves are secured, in this position, against untwisting.

When a relatively long thread portion is delivered into the spinning cell, and is subsequently drawn off again from the spinning cell to form the thread-joining reserve, then as long as the vacuum is still effective this thread is exposed to the latter, so that even by clamping the threads it is not possible completely to prevent them from untwisting to a certain extent. Consequently, as a remedy for this, it is envisaged, according to a further feature, that immediately after it has been fed back into the thread-joining position each thread should undergo clamping in this position, and that, during starting, synchronous drawing-off of the threads from the bobbin and the deflection of these while maintaining the clamping, result in the formation of thread-joining reserves which are then released simultaneously after the spinning cells have been put into operation.

In order to provide, for the common joining of all of the threads, constant joining conditions not only for the threads, but also for the spinning cells, it is advantageous if the latter undergo cleaning, whilst the thread ends are secured against untwisting.

In an open-end spinning machine which has a service device movable along the machine for preparing the threads for joining and for feeding them to the individual spinning cells, and a central control device which has a stopping device and a starting device for the open-end spinning machine, it is envisaged, for carrying out the process, that the stopping device be connected in control terms to a switch-on device and to a switch-off device for the service device. By means of the stopping device, in conjunction with the stopping program for the open-end spinning machine, the service device for carrying out the thread preparation and for feeding the threads to the individual spinning cells is put into operation. When the service device has attended in this way to all the spinning units assigned to it, it is stopped automatically by the switch-off device. By means of the apparatus according to the invention, it is therefore possible to leave the open-end spinning machine to run itself, after the stopping program has ended, since the preparation and feeding of the thread ends to its spinning cells are carried out without further action from outside, and the service device is switched off automatically after this work has been concluded.

To allow a simple control for the service device, it is envisaged, in an embodiment of the invention, that the switch-off device be actuable by the service device, after the servicing work has been carried out, at all the spinning units assigned to it. It is appropriately envisaged, for this purpose, that the open-end spinning machine should have two end positions assigned to the service device, in which case as a result of actuation of the stopping device, the service device can be delivered to the first end position as a starting-point for the servicing work, and the open-end spinning machine has, in the second end position, a limit switch actuable by the service device for actuating the switch-off device.

So that it is possible to control the service device in an especially simple way for the servicing work intended for preparing mass thread-joining, it is envisaged, in an appropriate embodiment subject of the invention, that the service device should have a limit switch which is actuable by the service device by means of a fixed stop of the open-end spinning machine when the first end position is reached. Since the service device will not only be active in connection with the stopping program of the open-end spinning machine, but has to carry out servicing work even during the normal spinning operation, the fixed stop can advantageously be brought into and taken out of its working position by means of the central control unit. Thus, when the stopping device is actuated, the stop is brought into its working position in which, when the servicing device runs onto the limit switch, it initiates its work for preparing the so-called mass thread-joining, while, after conclusion of this work, it is brought into its position of rest, as triggered by the service device, during actuation of the limit switch located in the second end position or as a result of actuation of the starting device, so that it is no longer possible to actuate the limit switch of the service device.

In an open-end spinning machine which is equipped with a thread-reserve device and a clamping device for securing the threads fed to the spinning cells, it is envisaged, according to the invention, that the threadreserve device and the clamping device of each spinning unit be actuable both by a control device located on the spinning machine and by a control device located on the service device. Because the thread-reserve device and the clamping device can be controlled both from the actual machine and from the movable service device, it is possible to control these devices either individually, when the machine is stopped for preparing the individual spinning units by means of the service device, or together during mass thread-joining from the machine itself, that is to say, independently of the service device.

Preferably, the thread-reserve device and the clamping device of each spinning unit are located on a slide displaceable transversely to the thread run, and in an appropriate design the slide is stressed elastically by a spring or the like in one of its directions of movement. It is therefore merely necessary to drive the slide by means of a controllable drive device in the direction opposite the stressing direction.

To make it possible, in a simple way, and without impairing the threads introduced into the spinning cells, to clean the spinning cells in conjunction with the interruption in production, it is envisaged, according to a further feature of the invention, that the thread reserve and the clamping device of each spinning unit be connected in control terms to a cleaning device via the central control device. It is thereby possible to control a cleaning device located centrally on the service device or provided separately for each spinning unit, in such a way that during the cleaning operation the threads do not become loose and thereby destroy again the effect achieved as a result of the preparation carried out previously.

The invention therefore provides a possibility of mass thread-joining, while nevertheless making use of the advantages of individual thread-joining, together with the preparation of the thread ends which can be carried out at the same time. This gives rise to piecers of high quality which have only slight and inconspicuous deviations from the normal thread structure and the strength of which corresponds to that of the normal thread. Since all the work necessary for this occurs outside the production time, there is no breakdown in production, so that the advantages which can be achieved do not, as hitherto, have to be gained at the expense of a production loss.

DESCRIPTION OF THE DRAWINGS

Further advantages and details are explained below with reference to the drawings in which.

DESCRIPTION OF A PREFERRED EMBODIMENT

Figure 1:
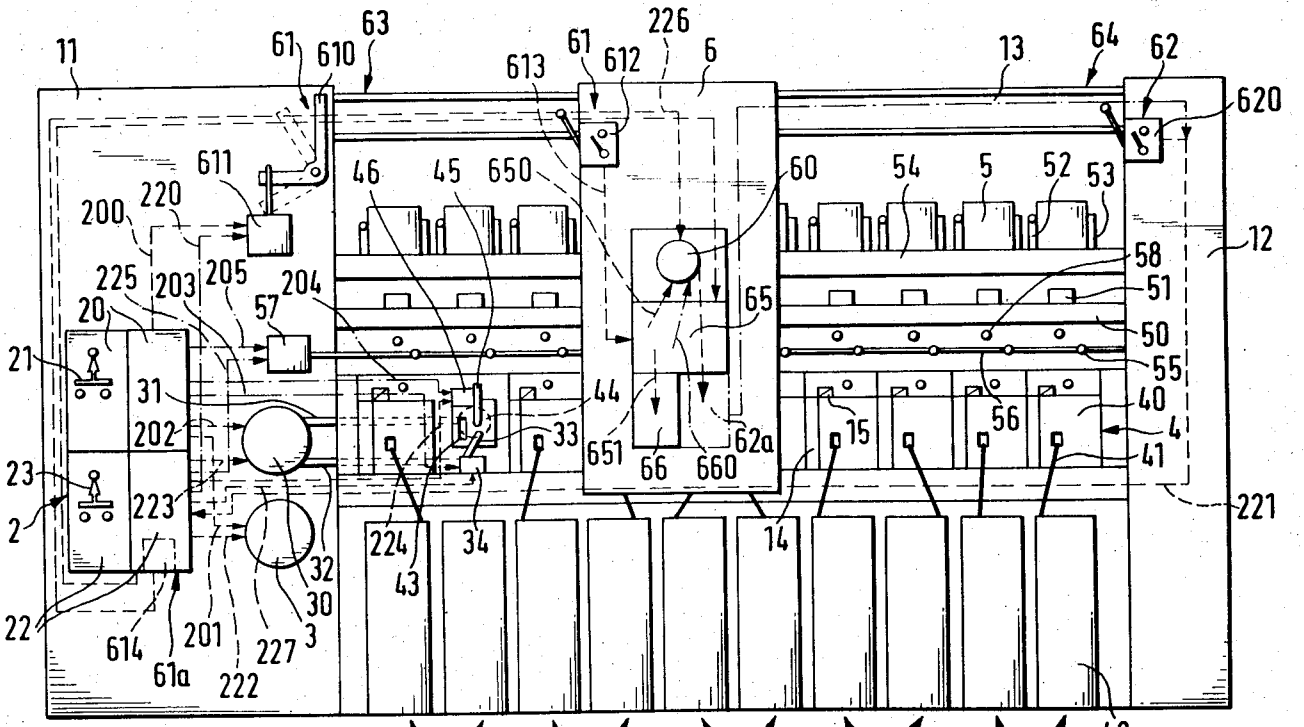
FIG. 1 shows, in a front view, an open-end spinning machine designed according to the invention.

The open-end spinning machine illustrated has, for example, ten spinning units 10; in practice, however, there are considerably more than this. The spinning machine itself is illustrated only diagrammatically, and all the elements not absolutely necessary for understanding the invention have been omitted for the sake of clarity.

The open-end spinning machine has at each of its ends an end frame 11 and 12, one (11) of which receives a control device 2 and the drive units 3. Between its end frames 11 and 12, the open-end spinning machine has for each spinning unit 10 a spinning cell 4 which is covered by a cover 40 and to which the fiber material 41 to be processed is presented by means of a spinning can 42. On the second spinning unit 10 from the left, the cover 40 is not shown for the sake of clearer illustration. The fiber material 41 is fed to the spinning cell 4 by conventional means and is, at the same time, loosened into individual fibers. These feed and loosening means are not shown; only part of the fiber feed channel 43 leading from the loosening device to the spinning cell 4 may be seen on the second spinning unit 10 from the left.

The individual fibers are deposited on a fibercollecting surface 44 of the spinning cell 4 and are spun into a thread end (not shown) which is drawn off from the spinning cell 4 through a draw-off tube 45 by means of draw-off rollers 50 and 51 and is wound onto a bobbin 5 which is retained between two pivotable bobbin arms 52 and 53 and which is driven by a drive shaft 54 extending over the entire length of the open-end spinning machine. A known traversing device (not shown) is located in front of the bobbins 5 in the direction of the thread run.

The end frames 11 and 12 of the open-end spinning machine are connected to one another by a rail 13 on which a service device 6 is movable along the machine. For this purpose, the service device 6 has a traveling drive 60 which is connected electrically via a line 226 to the control device 2 in the end frame 11.

The central control device 2 comprises a starting device 20 and a stopping device 22 for the open-end spinning machine. Both the starting device 20 and the stopping device 22 have press-buttons 21 and 23 respectively to actuate them. The stopping device 22 is connected both to a switch-on device 61 and to a switch-off device 62 for a control device 65 of the service device 6; furthermore, the stopping device 22 is connected via a line 226 to the traveling drive 60 of the service device 6.

According to the design illustrated, a stop 610 which is located on the end frame 11 and is controllable by means of an electromagnet 611 and to which a limit switch 612 is assigned, serves as a switch-on device 61. This electromagnet 611 is connected, on the one hand, via a line 220 to the stopping device 22 and via a line 200 to the starting device of the central control device 2. The limit switch 612 is attached to the service device 6 and is connected via a line 613 to the control device 65.

The position of the service device 6, in which its limit switch 612 can be actuated by the stop 610 located in the working position, defines a first end position 63 on the open-end spinning machine. A second end position 64 on the open-end spinning machine is defined by the position in which the service device 6 actuates a limit switch 620 which is located on the other end frame 12 or on the other side of the same end frame 11 of the machine and which forms the abovementioned switch-off device 62. This switch-off device 62 is connected via a line 221 to the stopping device 22 of the open-end spinning machine. Since this stopping device 22 is also connected via a line 222 to the service device 6, especially to its traveling drive, the switch-off device 62 also controls the service device 6 via the stopping device 22.

The service device 6 contains two control devices 65 and 66, the control device 65 of which serves for preparing the simultaneous joining of the threads on all the spinning units 10 when the open-end spinning machine is restarted after a shutdown, while the control device 66 serves for eliminating faults or for carrying out a bobbin change during normal production. The control device 65 is connected to the control device 66 (see arrow 651) in such a way that the control device 65 switches off the control device 66 for a time during which the control device 65 is switched on. Both the control device 65 and the control device 66 act on the traveling drive 60 of the service device 6 (see arrows 650 and 660).

The drive units 3 located in the end frame 11 of the open-end spinning machine are connected via lines 201 and 222 both to the starting device 20 and to the stopping device 22. From these, the feed devices, the loosening devices, the spinning cells 4, the draw-off rollers 50 and 51, the drive shaft 54 for the bobbins 5, and the traversing device are driven in a known way. At the same time, the devices mentioned above, but not shown are designed in a conventional way.

Also located in the end frame 11 is a vacuum source 30 which is connected via a line 202 and 223 to the starting device 20 and to the stopping device 22 respectively. The individual spinning cells 4 are connected via a suction-air channel 31 to the vacuum side of the vacuum source 30, while a compressed-air channel 32 is connected to the over-pressure side of the vacuum source 30. Compressed-air nozzles 33 branch off from the compressed-air channel 32, and these form the essential part of the cleaning device and can each be controlled via a valve 34. The valves 34 of the individual spinning units 10 are connected to the starting device 20 via lines 203.

On the draw-off tube 45 of each spinning cell 4 there is a clamping device 46 which, when actuated, can clamp the thread in the draw-off tube 45 and thereby secure it. The clamping devices 46 are connected in control terms via lines 204 and 224 both to the starting device 20 and to the stopping device 22.

Located in the thread run between each of the spinning cells 4 and the draw-off rollers 50 and 51 is a thread-reserve device 55, and these are connected to one another and to a drive 57 by means of a rail 56. The drive 57 is connected in control terms via lines 205 and 225 both to the starting device 20 and to the stopping device 22. Furthermore, for each spinning unit 10 a stationary thread guide 58 is assigned to the threadreserve device 55.

The cleaning device designed as compressed-air nozzles 33, the thread-reserve device 55 and the clamping devices 46 are therefore connected to one another in control terms via the central control device 2. The reason for this emerges from the following functional description.

The apparatus, the construction of which was described above, works as follows:

When the open-end spinning machine is to be shut down, for example at the end of a shift or at the weekend, the attendant actuates the press-button 23 of the stopping device 22 in the end frame 11. The drive units 3 are thereby shut down, with the result that the spinning process is interrupted. However, the vacuum source 30 continues to be applied. The attendant has finished his work and no longer needs to remain at the machine, since he no longer needs to supervise it because of possible production faults.

The electromagnet 611 is also actuated from the stopping device 22, and this pivots the stop 610 into the working position shown by an unbroken line, in which the limit switch 612 of the service device 6 can interact with it. Also switched on from the stopping device 22 via the line 225 is the traveling drive 60 of the service device 6, which brings the service device 6 into the first end position 63. In this end position 63, the limit switch 612 is actuated by the stop 610 located in its working position, with the result that the control device 65 of the service device 6 is put into operation.

The individual elements of the service device 6 are not shown since they are designed in a known way to receive the thread at the spinning unit 10, at which the service device is located at that moment, from the bobbin 5, to draw it off with simultaneous reverse rotation of the bobbin 5, to prepare it to be joined and then to guide it back to the spinning cell 4.

Since the vacuum source 30 is still effective, as a result of the vacuum effective in the spinning cells 4 the threads are immediately sucked into these and held tensioned.

The individual operations to be carried out by the service device can be modified, as desired, to adapt them to the machine, by the omission or addition of operations. If, for example, the thread does not pass onto the bobbin 5 at all, it is not necessary to seek the thread there, but it can be grasped in its thread run in front of the bobbin.

Preparation of the thread end can simply involve cutting to length; however, it can also include splicing open, moistening, etc., and cutting to length can also be effected by means of such splicing open. At the same time, the control device 65 (see arrow 650) controls the traveling drive 60 for the step-by-step movement of the service device 6 from spinning unit 10 to spinning unit.

When the service device 6 has attended to all the spinning units 10 assigned to it, it moves into the second end position 64 in which it actuates the limit switch 620. The stopping device 22 now receives via the line 221 a signal, in response to which the stopping device 22 then controls the drive 57 for the thread-reserve devices 55. The threads of the individual spinning units 10 are therefore deflected in a V-shaped manner between the draw-off tubes 45 serving as fixed points and the thread guides 58. At the same time, the thread ends are drawn off from the fiber-collecting surfaces 44 until they no longer touch these. The clamping devices 46 are then actuated from the stopping device 22 and secure the threads in the draw-off tubes 45. The arrangement of the clamping devices 46 in the draw-off tubes 45 is selected in such a way that the thread end on the same side as the spinning cell also cannot be damaged as a result of the action of suction air or compressed air. This occurs, as a rule, when in the event of a spliced thread end only the spliced region is located within the spinning cell 4 in relation to the clamping device 46.

When the threads on all the spinning units 10 are secured in this way against untwisting, the valves 34 are controlled from the stopping device 22, so that compressed air is supplied to the spinning cells 4. At the same time, the spinning cells 4 can be rotated temporarily via the drive units 3, to ensure that the streams of compressed air reach the entire fiber-collecting surface. Detached dirt constituents are conveyed away via the suction-air channel 31 by the suction air which is still effective. When this has taken place, the stopping device 22 closes the valves 34, switches off the drive units 3 and cuts off the vacuum source 30. With this, the operation for shutting down the open-end spinning machine is concluded completely, and, in addition to the normal stopping of the machine, individual preparation of all the spinning units 10 for common starting and thread-joining of all the spinning units when the machine is started up again has taken place at the same time.

When the machine is switched on at the start of a new shift and the attendant actuates the press-button 21 of the starting device 20, the vacuum source 30 is first applied. The electromagnet 611 is also actuated so as to bring the stop 610 into the position of rest shown by broken lines, insofar as this has not already taken place as a result of a current drop during the stopping of the machine. As a result of the appropriate control of the drive units 3 and of the drive 57 for displacing the thread-reserve devices 55 to the right, the threads are fed simultaneously to the spinning cells 4 of the individual spinning units 10, whereupon the thread drawoff and the winding onto the bobbins 5 resume in a known way. Thread-joining proceeds in this way within a few seconds, so that yarn production can begin immediately at all the spinning units simultaneously, without a loss of production. During the time in which the open-end spinning machine produces normally, that is to say in the period between actuation of the press-button 21 and actuation of the press-button 23, the control device 66 is effective because the control device 65 is not switched on, and controls the servicing operations occurring during the normal production time.

Both the process described and the devices discussed can undergo many modifications. Thus, it is possible to guide the threads back to the spinning cells 4 by means of the service device 6 only so far that they do not pass on to their fiber-collecting surfaces 44 at all. In this position, they can then be secured, in turn, against untwisting by means of the clamping devices 46, during the shutdown time of the open-end spinning machine, so that even here, if desired, the spinning cells 4 can undergo cleaning during this time. This cleaning can then be carried out, according to choice, before the vacuum source 30 is cut off, in the course of shutting down the machine, or else in the course of the starting operation of the machine before the common thread-joining at all the spinning units 10 (see line 227).

At the same time, the procedure can then also be such that the threads first fed back into the spinning cells 4 onto the fiber-collecting surface 44 remain there during the shutdown of the open-end spinning machine and are drawn out of the spinning cells 4, and secured by clamping, only in the course of the starting operation by means of the control of the starting device 20 (see lines 205, 204 and 203), during which time the spinning cells 4 undergo a cleaning operation.

Building up the thread reserve and securing the thread end in the draw-off tube 45 can be carried out in various ways. Thus, it is appropriate to prepare the threads for mass thread-joining by means of the service device 6 from spinning unit 10 to spinning unit and to feed them to the individual draw-off tubes 45 and clamp them there by means of the clamping devices 46. When the service device 6 has attended to all the spinning units in this way, it forms the thread reserves as a result of displacement of the thread-reserve device 55 and the synchronous reverse rotation of the bobbins 5. Thread-joining then takes place in the way described, after the threads have been released by the clamping devices 46.

It is also possible to form the thread reserves only during restarting. In this case, the displaceable thread-reserve devices 55 are appropriately designed as throw-off members which can be retracted in relation to the rail 56, so that the threads are stripped off from the thread-reserve devices 55 by the rail 56 and solely as a result of the vacuum acting in the spinning cells 4 are sucked into the latter. Especially rapid and reliable thread-joining is achieved as a result.

Figure 2:
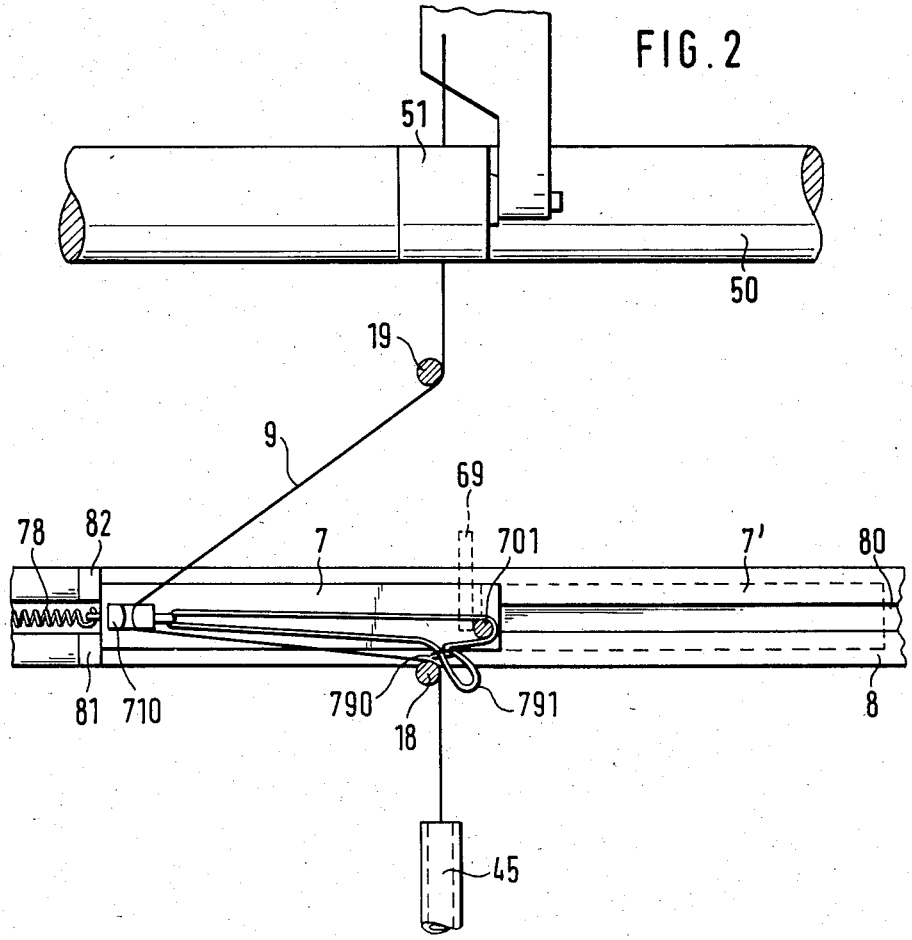
FIG. 2 shows a thread-reserve and thread-clamping device according to the invention.

An example of a device for forming the thread reserve and for clamping the thread is shown in FIG. 2. Between the draw-off tube 45 and the draw-off rollers 50, 51 are located two stationary deflecting pins 18 and 19 between which a control rail 8 is arranged so as to be displaceable transversely to the thread run. The control rail 8 has a longitudinal groove 80 in which a slide 7 is guided. The slide 7 is retained by means of a tension spring 78 against two stops 81, 82 of the control rail 8, to which the other end of the tension spring 78 is anchored. The slide 7 has a thread-deflection guide 710 and a retention pin 701 on which a rubber band 79 is retained. The rubber band 79 has a part portion which is shaped by means of a lug 790 into a loop 791 facing the draw-off tube 45. The retention pin 701 projects so far above the slide 7 that a drive lever 69 of the service device 6 can interact with it.

During the normal spinning process, the control rail 8 is in its right-hand end position (see the position 7' of the slide), and neither is the thread run between the draw-off tube 45 and draw-off rollers 50, 51 impaired by the thread-deflection guide 710 nor is the thread clamped on the deflecting pin 18 by the loop 791. When the open-end spinning machine is shut down, the control rail 8 moves into the (left-hand) end position shown, after the spinning process has ended. During the spinning operation, but also now during and after the displacement of the control rail 8, the slide 7 always rests against the stops 81 and 82. The result of this is that in the end position shown in FIG. 2 the loop 791 comes up against the deflecting pin.

Figure 3:
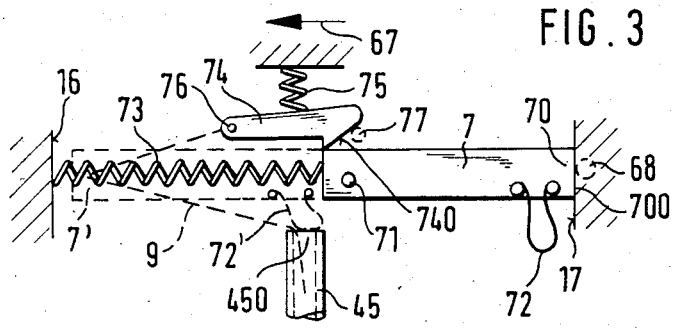
FIG. 3 shows another design of a thread-reserve and thread-clamping device according to the invention.

The service device 6 now moves along the spinning machine in the way described previously, so as to prepare spinning unit 10 after spinning unit 10 for the subsequent mass thread-joining operation. During this work, the drive lever 69 of the service device 6 engages on the extended retention pin 701, lifts the slide 7 off from the stops 81 and 82 and pushes it back into the initial position 7' against the effect of the tension spring 78, so that the direct thread run between the bobbin 5 (FIG. 1) and the draw-off tube 45 is freed. In this position, the loop 791 has also freed the deflecting pin 18. Preparation of the spinning unit 10 can therefore proceed in the way described, and the thread can be fed to the spinning cell 4 (FIG. 1). The drive lever 69 then releases the retention pin 701, and the slide 7 returns into the position shown in FIG. 2 where it again comes up against the stops 81 and 82. At the same time, with the thread being drawn off from the spinning cell 4 partially, the thread-deflection guide 710 forms a thread reserve 9 which is then released again during mass thread-joining. Moreover, the loop 791 clamps the thread against the deflecting pin 18. The distance between the deflecting pin 18 and the draw-off tube 45 is so short, here, that it is guaranteed that the thread cannot leave this. It can also be envisaged, however, that the loop 791 should interact with the mouth 450 of the draw-off tube 45 itself (FIG. 3,) as a result of which this aim is achieved with even greater certainty.

During mass thread-joining, the control rail 8 returns into its initial position (on the right in FIG. 2), and the loops 791 and the thread-deflection guides 710 of all the spinning units 10 release the threads which, as a result of the vacuum prevailing in the spinning cells 4, are sucked back into these.

A modification of the device described above is shown in FIG. 3. Located on each spinning unit, after the draw-off tube 45 and in the thread run, is a slide 7 which, when the spinning machine is stopped is movable parallel to the direction of movement of the service device 6, marked by an arrow 67. Guide rails (not shown) are provided, here, for guiding the slide 7. The slide 7 is stressed counter to the direction of the arrow 67 by a compression spring 73, the other end of which is supported on a stationary surface 16 of the machine. When the compression spring 73 is relaxed, the slide 7 rests by means of its end 70 on another surface 17 of the machine.

The slide 7 carries at its end facing the compression spring 73 a deflecting pin 71 and at its end 70 facing the surface 17 a clamping element 72 which is designed to interact with the mouth 450 of the draw-off tube 45. In the design illustrated, the clamping element 72 is designed as a rubber loop which can rest elastically against the mouth 450 (see 72').

The service device 6 carries a driver 68 which can engage behind the edge 700 of the end 70 of the slide 7 and can drive the slide 7 in its movement in the direction of the arrow 67.

Assigned to the slide 7 is an engagement pawl 74 which is pivotable about a pivot pin 76 and which, when the slide 7 is moved in the direction of the arrow 67 into its end position, engages behind the edge 700 of the end 70 and holds the slide 7 in this position. Assigned to the engagement pawl 74 for this purpose is a spring 75 which presses the engagement pawl 74 against the slide 7. The engagement pawl 74 has on its side facing away from the pivot pin 76 a slope 740 to which is assigned a control pin 77 movable in the direction of movement of the service device 6.

After the spinning operation has ended, the service device 6 begins its work in the way described, to prepare the individual spinning units 10 (see FIG. 1) for subsequent mass thread-joining. During this time, it moves along the spinning machine in the direction of the arrow 67. When the thread end has been prepared at a spinning unit 10 and has been fed back into the draw-off tube 45, the service device 6 starts to move again so as to arrive at the adjacent spinning unit 10. During this movement, the driver 68 of the service device 6 engages behind the edge 700 of the slide 7 and drives the latter until the engagement pawl 74 engages behind the edge 700. At the same time, the compression spring 73 is tensioned. The driver 68 then releases the slide 7 again.

During this movement, the deflecting pin 71 draws a certain length of thread off from the spinning cell 4 and forms from it a thread reserve 9 for the subsequent thread-joining operation. Moreover, the clamping element 72 designed as an elastic loop comes up against the mouth 450 of the draw-off tube 45 and thereby secures the thread. In this way, the spinning units 10 are prepared successively for subsequent mass thread-joining, and the spinning machine is then switched off completely.

During mass thread-joining, the control pin 77 is then moved in the direction of the arrow 67 on all the spinning units 10 together. When the control pins 77 run onto the slopes 740, the engagement pawls 74 are lifted simultaneously on all the spinning units 10 and the slides 7 are released, and these return abruptly into their basic positions as a result of the compression springs 73 which relax. At the same time, the deflecting pins 71 release the thread reserves 9 and the clamping elements 72 free the mouths 450 of the draw-off tubes 45. The threads now exposed to the vacuum acting in the draw-off tubes 45 are therefore sucked into the spinning cells 4 where they make contact with the fibers, fed in in the meantime, and spin these in. Redrawing-off can now start in the conventional way.

So that the thread reserves can be controlled in a simple way from the service device 6, it is advantageous if these thread reserves are formed perpendicularly to the plane of representation, that is to say transversely to the longitudinal extension of the machine. For this purpose, for example, the rail 56 can engage on the angularly designed thread-reserve yoke. During preparation of the thread end, these thread-reserve yokes are pivoted by the service device 6 so that they deflect the thread, with the result that the latter cannot leave the thread draw-off tube 45 within the spinning cell 4 and untwist. After the service device 6 has attended to all the spinning units 10, the thread-reserve yokes (not shown) release, approximately simultaneously with the shutting off of the vacuum source 30, the threads which are now sucked completely into the spinning cell 4. However, the threads are exposed, suspended, to the vacuum for only a very short time within the spinning cells 4. During the shutdown of the spinning machine, the long thread length located in the draw-off tube 45 and in the spinning cell 4 prevents the thread from untwisting. During the subsequent mass thread-joining, the thread reserves are formed again simultaneously with the application of the vacuum source 30, and they are then released abruptly for piecing carried out in the known way.

It is also possible to arrange the cleaning device in the service device 6, so that the latter attends to the spinning cells 4 one after the other. For this purpose, each spinning unit 10 has a control lever 14 which is unlocked, from the service device 6, as a result of actuation of a control button 15 and, as a result of swinging back into the basic position shown, is locked in this. In this case, the stopping device 22 merely controls the fiber feed to the spinning cell 4, while the drive of the spinning cell 4 and the valve 34 are controlled as a result of the control lever 14 swinging open and swinging shut. The drive units 3 are stopped only after the switch-off device 62 has been actuated. Since this cleaning then takes place before the feedback of the threads, the clamping devices 46 can be omitted.

After the spinning cells 4 have started up, the threads are fed to the fiber-collecting surfaces 44 of the spinning cells 4. This can be carried out, in a known way, as a result of the reverse rotation of the bobbins 5 or also by releasing thread-joining reserves which have previously been formed by the thread-reserve devices 55. Thread-reserve devices 55 are therefore also not necessary under all circumstances, although they are highly advantageous because of the rapid thread release.

In the design shown, the service device 6 is switched on in a fixed end position 63, for carrying out the servicing work preparing subsequent mass threadjoining, and for this purpose the switch-on device 61 consists of an electromagnet 611, a stop 610 and a limit switch 612.

In the design described, the service device 6 starts at one end of the machine and ends the preparatory work for mass thread-joining at the other end of the machine. However, it is also perfectly possible for the service device 6 to start its work at one end of the machine on one side, move round the other end and finish the preparatory work at the first end of the machine on the opposite side. If desired, preparatory work of this type can also be carried out, in a suitably modified way, on several machines by means of a service device, by providing appropriate controllable rail transitions from one machine to the other.

The switch-on device **61*a* can also be formed by an integrated part 614 of the stopping device 22 which actuates the control device 65 directly. There can be assigned to the control device 65 a switch-off device 62*a* (instead of the switch-off device 62) which is designed as a timer or a displacement step counter. In the first case, after an adjustable time has expired, the switchoff device 62*a* switches off the service device 6 and also the stopping device 22, this time being calculated so that normally all the spinning units 10 are prepared, within this interval of time, for mass thread-joining to be carried out during starting. In the second case, the displacement steps of the service device 6 are counted. After the predetermined number of displacement steps, corresponding to the number of spinning units assigned to the service device, has been reached, the service device 6 and the stopping device 22 are shut down. In the last case, as in the case described first of all, it is guaranteed that the switch-off device 62 or 62*a* is actuable only after the servicing work has been carried out on all the spinning units 10** assigned to it.

In the design described, the service device 6 is switched off from the stopping device 22. However, the service device 6 can also have a limit switch (not shown) which, when the second end position 64 is reached, is actuated by the end frame 12 and thus controls the service device 6, whilst the limit switch 620 merely controls the stopping device 22.

Instead of the control of the control device 66 by means of the control device 65, the change-over between these control devices 65 and 66 can also take place from the starting device 20 and from the stopping device 22. A controllable stop 610 is not required even when the service device 6 is to be brought into the first end position 63, for the preparatory work for thread-joining, in the course of shutting down the open-end spinning machine. Then, one and the same limit switch 612 can, depending on whether it is in the control circuit of the starting device 20 which adjusts the production range in the service device 6 or whether it is in the control circuit of the stopping device 22 which initiates preparation of mass thread-joining, serve both as a direction-reversing switch for normal servicing work, during normal production, and as a starting switch for preparing mass thread-joining, during the stopping program.

Further modifications resulting from an exchange of elements by equivalents or resulting from a combination with one another come within the scope of the present invention.

We claim:

1. A process for stopping and restarting an open-end spinning machine with a plurality of spinning devices, each of which contains a spinning cell working under vacuum and having a fiber-collecting surface, and a spooling device, said process comprising the steps of stopping all the spinning device together while further maintaining the vacuum;

successively preparing the thread end resulting from the interruption of the spinning process at each spinning unit for thread-joining;

feeding each prepared thread end to its respective spinning device in a thread-joining position;

then, cutting off the vacuum;

starting the open-end spinning machine after the vacuum has been applied;

feeding the threads located in the thread-joining position together, on all the spinning devices, to the respective fiber collecting surfaces thereby joining threads at all spinning devices and obtaining high grade piecers;

before the vacuum is cut off, performing the steps of: delivering up the thread to the fiber-collecting surfaces of the already stopped spinning cells and, before the spinning cells are put into operation, bringing the threads into the thread-joining position by drawing the threads simultaneously and partially out of the spinning cells while forming thread-joining reserves at the same time, said thread-joining reserves being released simultaneously after the spinning cells have been put into operation; and drawing the ends of the threads partially out of the spinning cells to form thread reserves and securing the threads in this position against untwisting.

2. The process as claimed in claim 1, wherein the thread-joining reserves are formed, during the thread-joining of the open-end spinning machine, after the vacuum has been applied.

3. The process as claimed in claim 1 including the step of cleaning the spinning cells while the thread ends are secured against untwisting.

4. An open-end spinning machine having a plurality of individual spinning cells comprising:

a service device movable along the machine for servicing cells assigned to it by preparing the threads for joining and by feeding the threads to the individual spinning cells;

a central control device having a stopping device and a starting device for the open-end spinning machine;

a switch-on device for the service device connected to said stopping device, said switch-on device putting the service device into operating for servicing said cells;

a switch-off device for the service device connected to said stopping device, said switching-off device stopping the service device after it has attended to its assigned spinning cells; and a thread-reserve device and a clamping device for securing the threads fed to the spinning cells, and control devices, one on said spinning machine and the other on said service device, said thread-reserve device and said clamping device of each spinning cell being actuable both by said control device located on the spinning machine and by said control device located on the service device.

5. The open-end spinning machine as claimed in claim 4, wherein said switch-off device is actuable by said service device after the servicing work has been carried out at all the assigned spinning units.

6. The open-end spinning machine as claimed in claim 5, wherein said open-end spinning machine has first and second end positions assigned to the service device, and as a result of actuation of said stopping device, the service device can be delivered to the first end position as a starting-point for the servicing work, said open-end spinning machine including a second limit switch located in the second end position, said limit switch being actuable by the service device for actuating said switch-off device.

7. The open-end spinning machine as claimed in claim 6, wherein the service device includes: a first limit switch and a fixed stop, said limit switch being actuable by the service device by means of said fixed stop when the first end position is reached.

8. The open-end spinning machine as claimed in claim 7 including a central control unit for bringing the fixed stop into and out of its working position.

9. The open-end spinning device as claimed in claim 4 including a slide displaceable transversely to the thread run, said thread-reserve device and said clamping device of each spinning unit being located on said slide.

10. The open-end spinning device as claimed in claim 9, wherein the slide is stressed elastically in one of its directions of movement.

11. The open-end spinning device as claimed in claim 4 including a cleaning device, said thread-reserve device and said clamping device being controllably connected to said cleaning device via a central control device.

12. A process for stopping and restarting an open-end spinning machine having a plurality of spinning devices, each of which contains a spinning cell working under vacuum and having a fiber-collecting surface, and a spooling device, said process comprising the steps of:

stopping all the spinning devices together while further maintaining the vacuum;

successively preparing the thread end resulting from the interruption of the spinning process at each spinning unit for thread-joining;

feeding each prepared thread end to its respective spinning device in a thread-joining position;

then, cutting off the vacuum;

starting the open-end spinning machine after the vacuum has been applied;

feeding the threads located in the thread-joining position together, on all the spinning devices, to the respective fiber collecting surfaces thereby joining threads at all spinning devices and obtaining high grade piecers;

clamping each thread immediately after being fed back into the thread-joining position; and during starting, forming thread joining reserves by synchronous drawing-off and deflection of the threads while maintaining the clamping, said thread joining reserves then being released simultaneously after the spinning cells have been put into operation.

* * * * *